United States Patent [19]

Perman et al.

[11] 4,369,684

[45] Jan. 25, 1983

[54] APPARATUS FOR CUTTING STRIP MATERIAL

[75] Inventors: Gifford T. Perman; David A. Poff, both of Gainesville, Fla.

[73] Assignee: General Electric Company, Gainesville, Fla.

[21] Appl. No.: 208,103

[22] Filed: Nov. 18, 1980

[51] Int. Cl.[3] ..... B26D 1/18; B26D 1/20

[52] U.S. Cl. ..... 83/216; 83/447; 83/486.1; 83/488; 83/508; 83/578

[58] Field of Search ..... 83/486.1, 486, 488, 83/578, 559, 508, 614, 34, 215, 216, 447

[56] References Cited

U.S. PATENT DOCUMENTS

| | | | |
|---|---|---|---|
| 524,501 | 8/1894 | Kendall | 83/215 |
| 1,732,149 | 10/1929 | Barrett | 83/486 X |
| 3,122,042 | 2/1964 | Littell et al. | 83/215 |
| 3,138,049 | 6/1964 | Flory et al. | 83/486 X |
| 3,207,016 | 9/1965 | Huff | 83/488 X |
| 3,207,019 | 9/1965 | Vanzo et al. | 83/488 X |
| 3,354,769 | 11/1967 | Abramson et al. | 83/614 X |
| 3,503,291 | 3/1970 | Pouilloux | 83/578 X |
| 3,538,800 | 11/1970 | Pshenichny et al. | 83/216 X |
| 3,584,528 | 6/1971 | Leblond et al. | 83/578 X |
| 3,659,795 | 5/1972 | Bachi et al. | 83/216 X |
| 4,010,664 | 3/1977 | Marshall | 83/486.1 X |

*Primary Examiner*—Frank T. Yost

*Attorney, Agent, or Firm*—Henry J. Policinski

[57] ABSTRACT

An improved apparatus for cutting strip material is disclosed in which a strip (16) such as flattened plastic tubing is intermittently fed across a cutting edge (64, 66) mounted on a rotatable platform (34). A cutting element (84098) is moved back and forth along the cutting edge to sever the strip into segments having a leading edge at one angle to the axis o- the strip and a trailing edge at another angle.

3 Claims, 6 Drawing Figures

FIG. 4
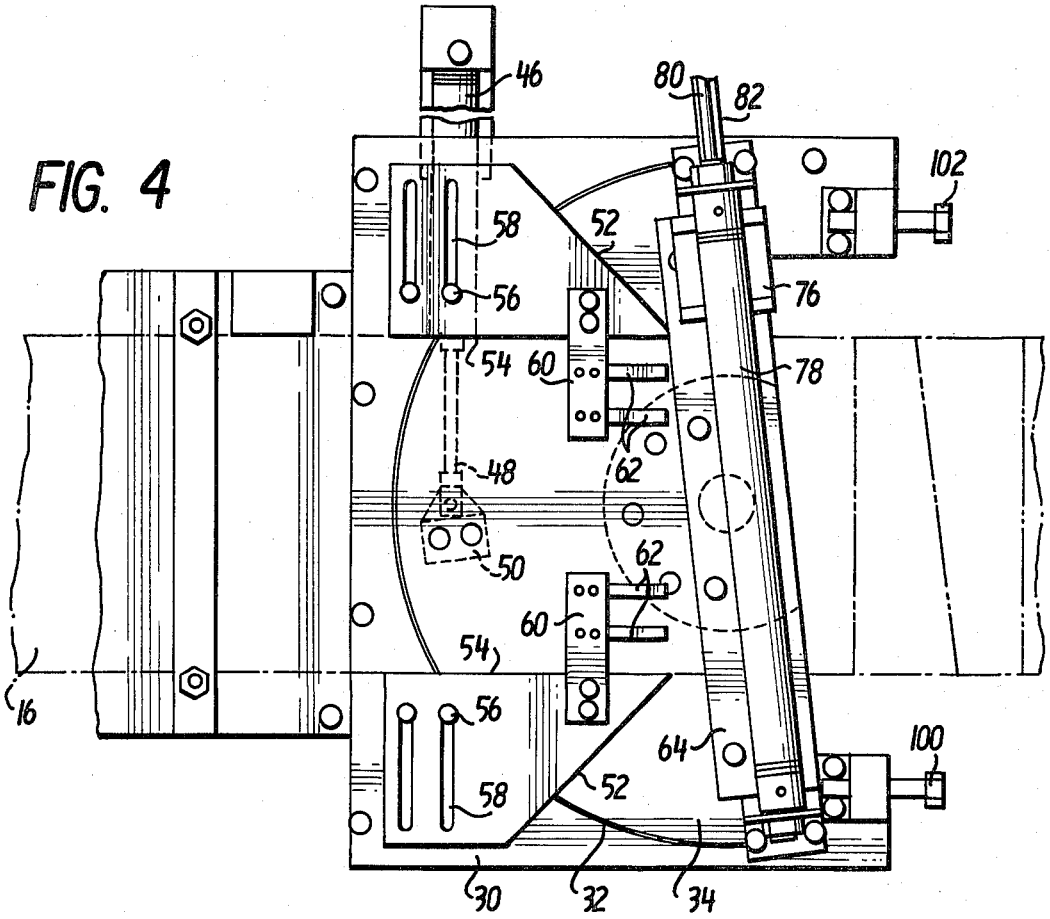
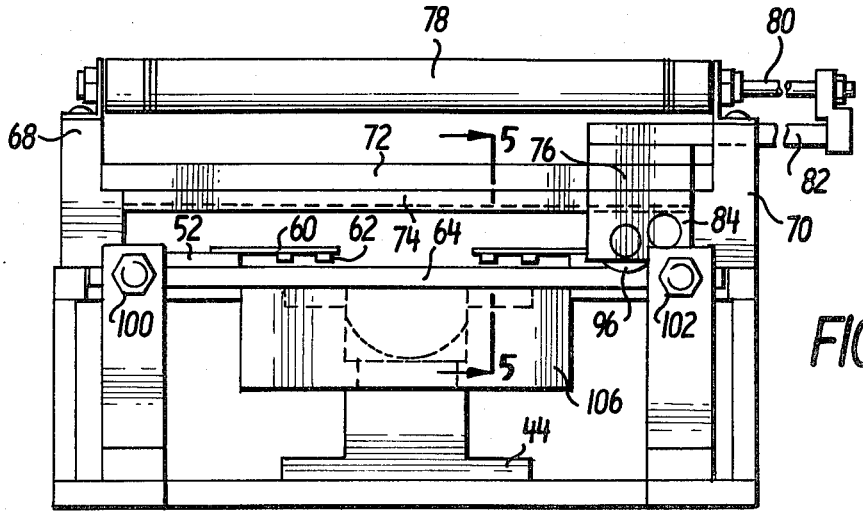
FIG. 3

APPARATUS FOR CUTTING STRIP MATERIAL

DESCRIPTION

TECHNICAL FIELD

The invention concerns apparatuses for cutting strip material into segments having leading and trailing edges extending across the axis of the strip. More particularly, the invention concerns such apparatuses which include a provision for automatically changing the angle of the leading and trailing edges with respect to the axis of the strip as the strip progresses through the apparatus.

BACKGROUND ART

Various machines and methods have been used in the past to cut a strip of material into segments for subsequent applications. Depending upon the intended use of the segments of strip material and the composition of the material itself, such machines and methods have been of varying complexity and cost. For example, in the paper industry highly complex machinery is used to cut oversize rolls of paper stock into commercially attractive sizes. In the metals industry other types of machines are used to cut metal strips into plates and foils, for example. Rather commonly, the strip materials are cut into rectangular sheets.

For some applications, however, the strip material must be cut into segments having non-rectangular shapes in which the leading and trailing edges of individual segments are at different angles to the axis of the strip. Equipment for cutting such non-rectangular shapes has tended to be complex and expensive; thus, a need has continued to exist for a simple, inexpensive apparatus for making these types of strip segments.

DISCLOSURE OF THE INVENTION

The primary object of the present invention is to provide an improved apparatus for cutting strip material into segments.

A further object of the invention is to provide such an apparatus which is particularly useful for cutting strips of light-weight materials such as flattened plastic film tubing, paper and the like into segments having square cut leading and trailing edges, one square cut and one angled edge or two equally angled edges.

Yet another object of the invention is to provide such an apparatus which will cut a strip of material into segments of a desired configuration without wasting any of the material.

These objects of the invention are given only by way of example. Thus, other desirable objectives and advantages inherently achieved by the disclosed structure may occur or become apparent to those skilled in the art. Nonetheless, the scope of the invention is to be limited only by the appended claims.

A preferred embodiment of the invention comprises a source such as a roll of strip material and a means for intermittently feeding the strip material along a predetermined path. The means for intermittently feeding the strip material may be any one of a number of such devices known to those skilled in the strip feeding technologies which are effective to advance a strip of material a preselected distance and then clamp and hold the material for a predetermined interval of time before advancing it again. One such intermittent feeder is the model H8 sold by the Rapid-air Corporation of 821 First Street, S.W., Madison, South Dakota. Those skilled in the art will appreciate that other types of intermittent feeders may be used without departing from the scope of the present invention.

Operatively associated with the intermittent feeder is a means both for cutting the strip across its width at a first angle to and at a first position along the axis of the strip, and for cutting the strip across its width at a second angle to and at a second position along the axis of the strip, the second position being spaced from the first position due to movement of the strip caused by the intermittent feeder. In the preferred embodiment of the invention, the cutting means cuts the strip starting on one side thereof at the first position on the strip and starting on the other side thereof at the second position. The cuts across the strip may be made square with the axis of the strip at both ends, angled at one end and square at the other or equally angled at both ends, as desired.

The apparatus for cutting the strip preferably comprises a stationary support table having a surface onto which the strip is fed by the intermittent feeder. A cutting plate is attached to the table and oriented across the path traversed by the strip, the cutting plate having a first cutting edge. A pneumatically driven turntable is provided for rotating the cutting plate beneath the strip between first and second positions. A cutting element having a further cutting edge is positioned on the turntable to move back and forth along the first edge of the cutting plate, to cut the strip into segments. Preferably, the cutting element is a gear-driven cutting wheel mounted on a carriage which moves back and forth above the strip under the influence of a pneumatically driven cylinder. The carriage moves on a guide track having a gear rack on the underside thereof, the rack being meshed with a gear which drives the cutting wheel. Means are provided for guiding the strip over the first cutting edge and for limiting the rotating movement of the turntable.

BRIEF DESCRIPTION OF THE DRAWINGS

FIG. 3 shows an end view of the apparatus according to the invention taken from the left end of the apparatus illustrated in FIGS. 1 and 2.

FIG. 4 shows a partial plan view of the apparatus according to the invention in which the cutting mechanism has been positioned to make an angled cut across a strip of material shown in phantom.

BEST MODE FOR CARRYING OUT THE INVENTION

Figure 1:
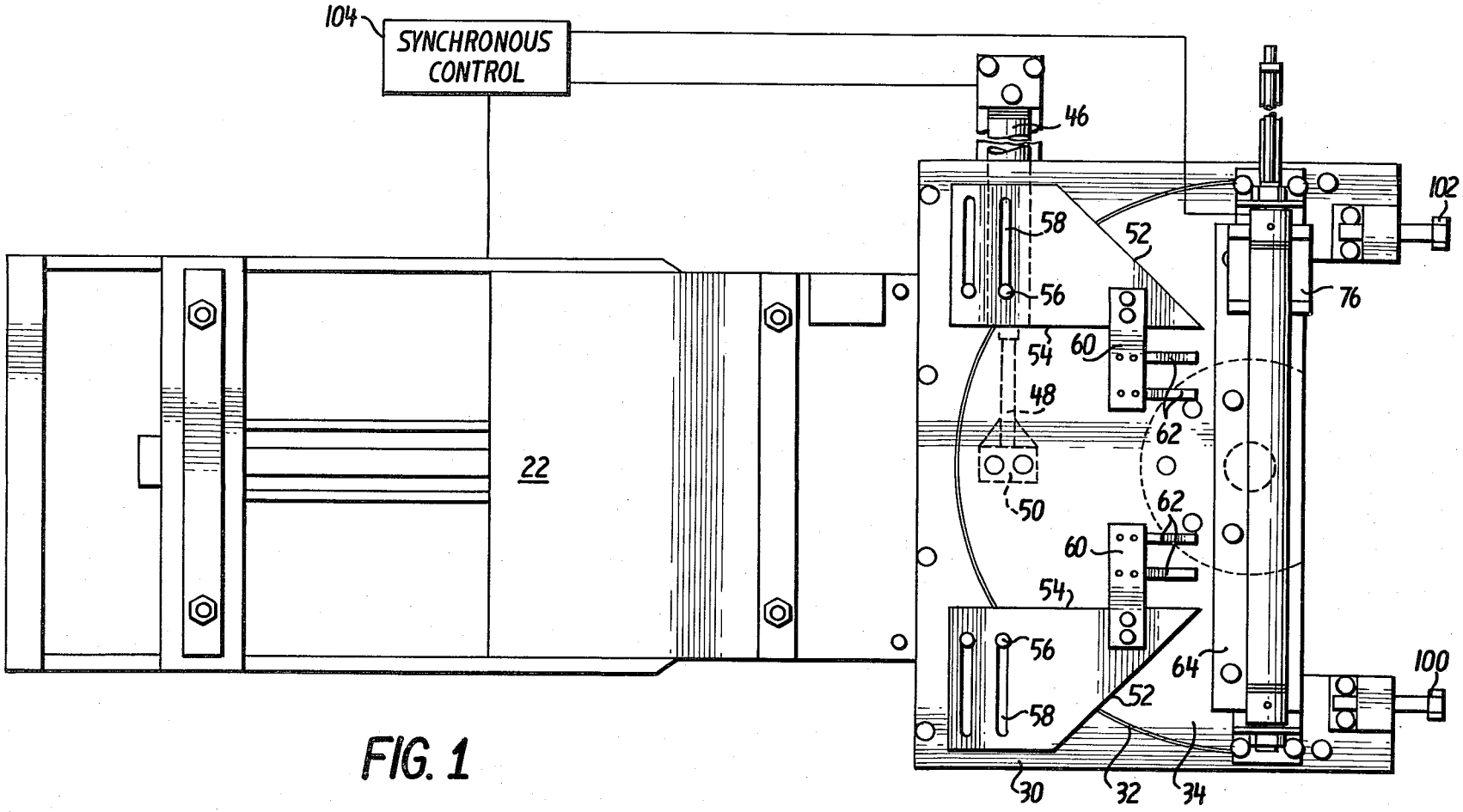
FIG. 1 shows a plan view of the apparatus according to the present invention in which the cutting mechanism has been positioned to make a square cut across a strip of material.

The following is a detailed description of the preferred embodiment of the invention, reference being made to the drawings in which like reference numerals identify like elements of structure in each of the several Figures.

Figures 2, 5, 6:
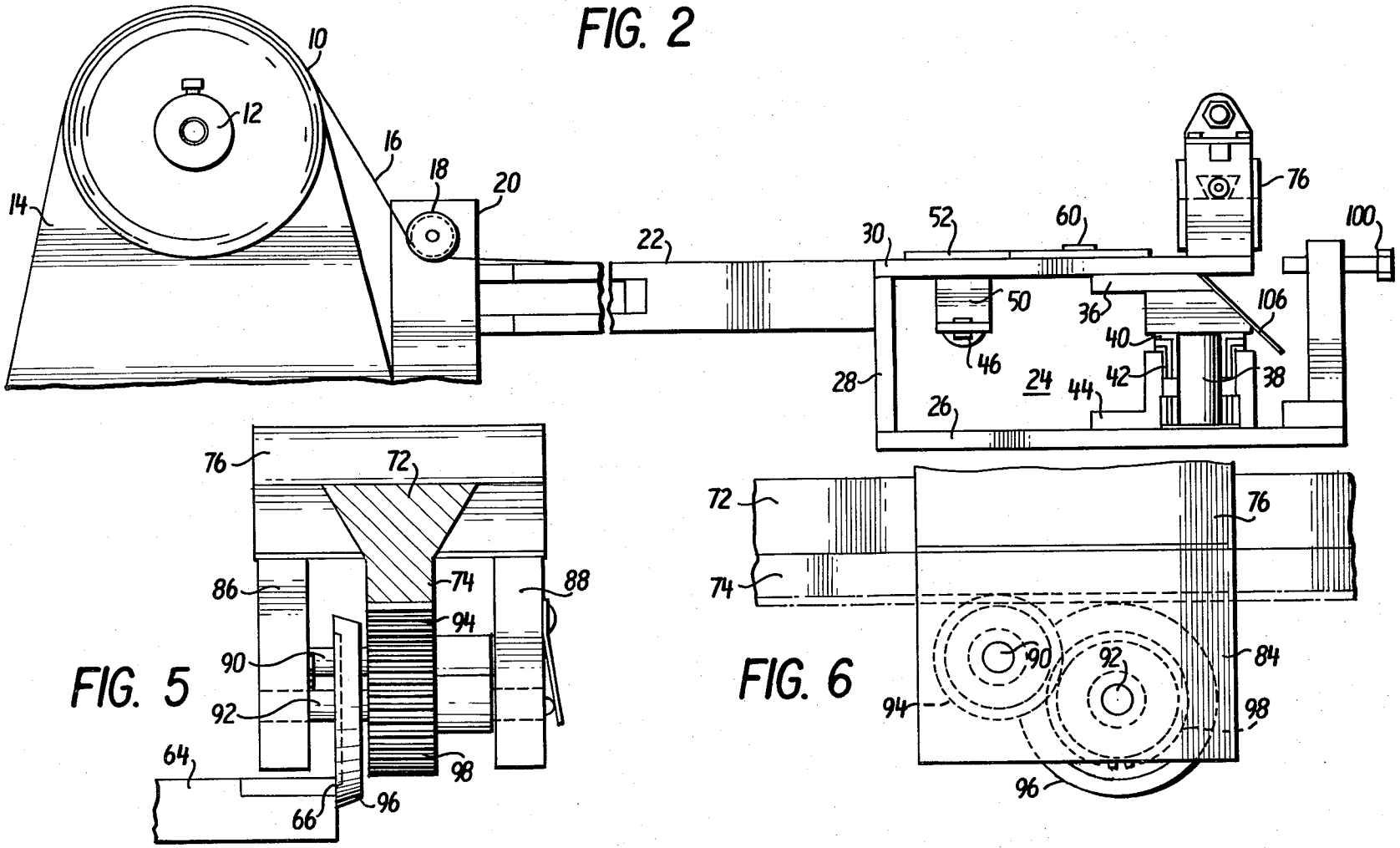
FIG. 2 shows a side elevation view of an apparatus according to the invention indicating the manner in which the strip material is fed from a storage roll to the cutting station.
FIG. 5 shows a view, partially in section, taken along line 5—5 of FIG. 3, illustrating the driven cutting wheel according to the present invention.
FIG. 6 shows a fragmentary view taken from the left side of FIG. 5.

Referring simultaneously to FIGS. 1 to 4, the structure and function of the apparatus according to the invention may be understood. A supply roll 10 of strip material is mounted for rotation on a roll support shaft 12 which extends from a support bracket 14. A strip 16 of the material is fed from roll 10 beneath an idler roller 18 which is rotatably mounted on a suitable support bracket 20. From roller 18, strip 16 is threaded through a conventional intermittent feed press 22 which grasps the strip in the familiar manner and feeds it in increments towards the right, as illustrated in FIGS. 1 and 2.

From feeder 22, the strip passes over a support table 24 which comprises a rigid base plate 26 having at its rear edge an upwardly extending support plate 28 to which is attached a rigid top plate 30. The center portion of top plate 30 is cut out to provide a semi-circular opening 32 within which is positioned a semi-circular turntable 34 whose upper surface is aligned with that of top plate 30. Turntable 34 in turn is mounted on a massive support plate 36 from which a shaft 38 extends downwardly through a thrust bearing 40 and a needle bearing 42, the bearings being mounted on base plate 26 by means of a suitable bearing support 44. Rotation of turntable 34 is controlled by a suitable air cylinder 46 which is mounted to the under surface of top plate 30 and connected to turntable 34 by means of a piston rod and clevis assembly 42 which is pivoted by means of a bracket 50 to the under surface of turntable 34.

As strip 16 progresses across the top of support table 24, its edges are positioned by a pair of strip guide plates 52 having spaced parallel guide edges 54. Plates 52 are adjustably mounted on top plate 30 by means of screws 56 which extend through parallel slots 58, thus permitting the plates to be moved toward and away from the center line of the apparatus. Each of guide plates 52 carries an inwardly extending hold down plate 60 to which are attached a pair of hold down leaf springs 62. Thus, strip 16 is centered above support table 24 by guide plates 52 and maintained in contact with the upper surface of turntable 34 by leaf springs 62. The right hand edge of turntable 34 is defined by a straight cutter plate 64 having a hardened cutting edge 66 positioned on the center line of shaft 38.

A pair of upwardly extending support plates 68, 70 are mounted on turntable 34 adjacent the ends of cutter plate 64. Between plates 68, 70 is mounted a guide track 72 having on its lower surface a gear rack 74. Slidably mounted on track 72 is a ball bearing slide or carriage 76. Extending parallel to track 72 between supports 68, 70 is a further air cylinder 78. The actuator shaft 80 of this cylinder is attached at its outer end to a carriage drive shaft 82 which extends beneath shaft 80, through an aperture in support 70, into attachment with carriage 76. Thus, actuation of cylinder 78 will cause carriage 76 to reciprocate on track 72.

Referring now to FIGS. 3, 5 and 6, the driven cutter wheel assembly 84 according to the invention may be understood. Assembly 84 is attached to the underside of carriage 76 and comprises a pair of downwardly extending side plates 86, 88 between which a pair of shafts 90, 92 are mounted for rotation. A drive gear 94 is mounted for rotation with shaft 90 and is meshed with gear rack 74. On shaft 92 are provided a hardened cutter wheel 96 and a cutter gear 98 which meshes with drive gear 94.

To operate the apparatus according to the invention, strip 16 is threaded past roller 18, through intermittent feeder 22, between guide plates 52, beneath leaf springs 62 and somewhat past cutting edge 66. Depending upon the desired shape of the strip segments, a pair of stop screws 100, 102, mounted on top plate 30 are adjusted to limit the rotational movement of turntable 34. Carriage 76 is then moved to one end of track 72 and automatic operation of the machine may begin under the direction of a synchronous control 104 which times the operation of feeding mechanism 22, air cylinder 46 and air cylinder 78. Control 104 may be pneumatic, hydraulic, electrical or a combination of these types as will be readily understood by those skilled in the art. Carriage 76 initially moves across track 72 to form the first cut through strip 16. Then, as intermittent feeder 22 moves strip 16 between guide edges 54 and across the upper surface of turntable 34, air cylinder 46 is actuated to rotate turntable 34 for the next cut during which carriage 76 moves in the opposite direction. The severed segments of strip 16 then fall away for subsequent handling down a chute plate 106. Intermittent feed mechanism 22 is then actuated to repeat the process.

INDUSTRIAL APPLICABILITY

Although the apparatus according to the invention has been disclosed for use with light-weight materials such as paper and plastic film tubing, those skilled in the art will appreciate that the principles of the invention may be applied for cutting other materials without departing from the scope of the appended claims.

Having described our invention in sufficient detail to enable those skilled in the art to make and use it, we claim:

1. Apparatus for cutting a strip of sheet material into segments, comprising:

a source of strip material, said strip having an axis;

means for feeding said strip material;

means operatively associated with said means for feeding, both for cutting said strip across its width starting on one side at a first angle to and at a first position along said axis, and for cutting said strip across its width starting on the other side at a second, different angle to and at a second position along said axis, said second position being spaced from said first position due to movement of said strip by said means for feeding; said means for cutting comprising a support table having a top surface onto which said strip is fed by said means for feeding; a cutting plate mounted on said table and oriented across the path traversed by said strip, said cutting plate having a first cutting edge; a guide track supported on said support table adjacent said cutting plate and across said path, said guide track comprising a gear rack on one side thereof; a carriage mounted for movement on said guide track, said carriage comprising a cutting wheel having at its periphery a second cutting edge, a shaft for mounting said cutting wheel for rotation with said second cutting edge adjacent said first cutting edge, a gear mounted on said shaft for rotation with said cutting wheel and gear means meshed with said gear and said gear rack for rotating said cutting wheel in opposite directions for cutting said strip at said first and second angles; means for moving said carriage along said guide track; and means for rotating said cutting plate, said guide track and said carriage between said first and second angles; and control means for timing the operation of said means for feeding and said means for cutting to intermittently and automatically feed said strip and stop it to effect a cut at said first angle; adjust said means for cutting for operation at said second, different angle; feed said strip and stop it to effect a cut at said second, different angle; and adjust said means for cutting for operation at said first angle.

2. Apparatus for cutting a strip of sheet material into segments, comprising:

a source of strip material, said strip having an axis;

means for feeding said strip material;

means operatively associated with said means for feeding, both for cutting said strip across its width starting on one side at a first angle to and at a first position along said axis, and for cutting said strip across its width starting on the other side at a second, different angle to and at a second position along said axis, said second position being spaced from said first position due to movement of said strip by said means for feeding, said means for cutting comprising a support table having a top surface onto which said strip is fed by said means for feeding; said support table comprising a stationary portion and a rotatable portion; a cutting plate mounted on said rotatable portion and oriented across the path traversed by said strip, said cutting plate having a first cutting edge; means for rotating said cutting plate between said first and second angles; a cutting element having a second cutting edge; said cutting element also being mounted on said rotatable portion; and means for moving said second cutting edge relative to said first cutting edge to cut said strip;

guide means, transversely adjustably mounted on said stationary portion and provided with parallel guide edges extending over said rotatable portion, for positioning the edges of said strip as it moves across said rotatable portion;

hold down means, supported by said stationary portion and provided with leaf springs for engaging the upper surface of said strip, for maintaining said strip in contact with said top surface of said rotatable portion; and control means for timing the operation of said means for feeding and said means for cutting to intermittently and automatically feed said strip and stop it to effect a cut at said first angle; adjust said means for cutting for operation at said second, different angle; feed said strip and stop it to effect a cut at said second, different angle; and adjust said means for cutting for operation at said first angle.

3. Apparatus according to claim 2, wherein said hold down means is mounted on said guide means.

* * * * *